US008390653B2

(12) United States Patent
Miwa

(10) Patent No.: US 8,390,653 B2
(45) Date of Patent: Mar. 5, 2013

(54) ELECTROLUMINESCENT PIXEL WITH EFFICIENCY COMPENSATION BY THRESHOLD VOLTAGE OVERCOMPENSATION

(75) Inventor: Koichi Miwa, Yokohama (JP)

(73) Assignee: Global OLED Technology LLC, Wilmington, DE (US)

( * ) Notice: Subject to any disclaimer, the term of this patent is extended or adjusted under 35 U.S.C. 154(b) by 550 days.

(21) Appl. No.: 12/634,737

(22) Filed: Dec. 10, 2009

(65) Prior Publication Data

US 2010/0177125 A1 Jul. 15, 2010

(30) Foreign Application Priority Data

Jan. 9, 2009 (JP) ..... 2009-003594

(51) Int. Cl.
*G09G 5/10* (2006.01)
*G09G 3/30* (2006.01)

(52) U.S. Cl. ..... 345/690; 345/77

(58) Field of Classification Search ..... None
See application file for complete search history.

(56) References Cited

U.S. PATENT DOCUMENTS 6,229,506 B1 5/2001 Dawson et al.
2006/0290614 A1* 12/2006 Nathan et al. ..... 345/76
2007/0285359 A1 12/2007 Ono
2008/0211397 A1* 9/2008 Choi ..... 313/504
2008/0231562 A1* 9/2008 Kwon ..... 345/77
2009/0051628 A1* 2/2009 Kwon ..... 345/77

OTHER PUBLICATIONS

Fish et al, Optical Feedback for AMOLED Display Compensation Using LTPS and a-Si:H Technologies, SID 05 Digest, pp. 1340-1343, 2006.

Shin et al, A New Stable a-Si:H TFT Pixel for AMOLED by Employing the a-Si:H TFT Photo Sensor, SID 08 Digest, pp. 1211-1214, 2005.

* cited by examiner

*Primary Examiner* — Christopher R Lamb
(74) *Attorney, Agent, or Firm* — McKenna Long & Aldridge, LLP

(57) ABSTRACT

In each pixel, a current-driven type light emitting element OLED, and a driving element T1 which controls an electric current to be supplied to the light emitting element in accordance with a data signal representing a target brightness, are provided. The mutual conductance of the driving element T1, or a parameter reflecting the mutual conductance, is detected, and the data signal to be supplied to the driving element is corrected in accordance with a detection result. More specifically, the data signal is corrected such that a driving current to be supplied to the light emitting element in accordance with the data signal increases as the mutual conductance of the driving element T1 decreases.

4 Claims, 4 Drawing Sheets

ELECTROLUMINESCENT PIXEL WITH EFFICIENCY COMPENSATION BY THRESHOLD VOLTAGE OVERCOMPENSATION

CROSS-REFERENCE TO RELATED APPLICATION

This application claims priority of Japanese Patent Application No. 2009-003594 filed Jan. 9, 2009 which is incorporated herein by reference in its entirety.

FIELD OF THE INVENTION

The present invention relates to a display apparatus in which a plurality of pixels are arranged in a matrix and each pixel is driven by a driving circuit.

BACKGROUND OF THE INVENTION

In an active matrix type organic electroluminescent (EL) display apparatus, each pixel is formed including a pixel circuit generally having, in addition to an organic EL element, two transistors and one capacitor (2T1C) serving as elements for driving the organic EL element. More specifically, a driving TFT which drives the organic EL light emitting element, a writing TFT which controls a data voltage to be applied to the driving TFT, and a storage capacitor which stores the data voltage are provided.

A channel of a TFT is generally formed of a thin film semiconductor such as amorphous silicon, microcrystal silicon, poly-crystalline silicon, an oxide semiconductor, an organic semiconductor, and so on.

In this case, a TFT drain current Id is determined by the following formula:

$$Id=0.5*(\mu C_{ch}*(W/L))*(V_{gs}-V_{th})^2$$

Here, μ represents a carrier mobility, $C_{ch}$ represents a channel capacitance, W and L represent a channel width and a channel length, respectively, $V_{gs}$ represents a gate-source bias, and $V_{th}$ represents a threshold voltage.

Here, degradation with time associated with a variation in mobility and a threshold voltage and application of bias is observed in any semiconductors. Also, drain current of the driving TFT to be supplied to the light emitting element depends on the mobility and the threshold voltage of the driving TFT. Accordingly, a variation in the mobility and the threshold voltage of a driving TFT in each pixel results in a variation of light emission brightness of each pixel with respect to a certain target brightness signal voltage input, which leads to non-uniform display characteristics.

In order to address the above problem, attempts to compensate for mobility and a threshold value of a driving TFT to thereby obtain uniform transconductance have been proposed. Such attempts include a $V_{th}$ compensation circuit for correcting the threshold voltage of a driving TFT (U.S. 2007-285359), current writing drive for correcting a threshold voltage and mobility (U.S. Pat. No. 6,229,506), and so on.

In the example described in U.S. 2007-285359, a threshold voltage of a driving TFT, which has been previously detected, is superposed on a data voltage and the resulting voltage is applied between gate and source of the driving TFT, to thereby cancel effects of the threshold voltage on the drain current of the driving TFT, so that driving current which does not depend on $V_{th}$ is supplied to a light emitting element. In this case, while a variation of mobility is not compensated, sufficient display uniformity can be achieved when effects of a variation of mobility upon the drain current are small.

In the example described in U.S. Pat. No. 6,229,509, a target brightness current is input to drain of a driving TFT in a state where the drain and gate of the driving TFT are short-circuited, to thereby induce a gate voltage required for applying a target current to the gate of the driving TFT. In this example, as not only a threshold voltage but also a variation of mobility are corrected, excellent display uniformity can be obtained even when a variation of mobility.

The two conventional examples described above are proposed attempts aimed at uniformity of drain current of a driving TFT, which is supplied to the light emitting element. In the actual display apparatuses, however, in addition to uniformity of the driving current to be supplied to the light emitting element, uniformity of current light emission efficiency of the light emitting element imposes significant effects on uniformity of the display brightness.

Normally, in driven-by-current type light emitting elements such as organic EL, a phenomenon in which the light emission efficiency is lowered in accordance with light emission of the elements can be observed. Recently, with the improvement of organic EL materials and light emitting element structures, organic EL elements having a constant current light emission brightness-half-life of tens of thousands of hours or more under average use conditions of a display apparatus are being reported.

In the applications of display apparatuses in which averaged use is expected for a whole display region, as the brightness is reduced substantially uniformly over the whole display screen, the brightness-half-life can be considered as an apparatus life. In this case, with the brightness-half-life of several tens of thousands of hours or more, no significant problems would occur in general applications.

However, in the applications of display apparatuses in which use of a large number of simple geometric patterns is assumed, such as mobile terminals, game terminals, PC monitor applications, and so on, the whole screen is used at random and uniform degradation cannot be expected.

In these applications of display apparatuses, a specific region in the screen and a region adjacent thereto are used with different frequencies and different brightness over a long period of time, which can result in a reduction in the light emission efficiencies which vary among different regions. This can cause image persistence of patterns on the screen, which is recognized by a viewer more sensitively than when the brightness of the whole screen is reduced uniformly. In most severe cases, a border between adjacent regions can be recognized if the difference of the brightness is approximately 2 or 3%. It is considered that such image persistence can be recognized with the brightness difference of approximately 5%, although it depends on the application of display apparatuses and patterns of image persistence.

As such, even if current supplied from the driving TFT is corrected in some manner, uniform brightness of the display apparatus can be inhibited due to a significant variation of light emission efficiency of the light emitting elements. In particular, in the applications of display apparatuses in which the product life depends on an image persistence life, it is necessary to correct a variation of light emission efficiency of the light emitting elements so as to secure a sufficiently long product life.

In order to correct degradation of a light emitting element itself, it is necessary to measure the light emission efficiency. Fish et al "Optical Feedback for AMOLED Display Compensation using LTPS and a-Si:H Technologies" SID 05 Digest, pgs 1340-1343 and Shin et al "A New Stable a-Si:H TFT Pixel for AMOLED by Employing the a-Si:H TFT Photo Sensor", SID 08 Digest, pgs. 1211-1214 propose to correct a reduction of the light emission efficiency (optical compensation) by providing a photodetector in a pixel and controlling a light emission period in accordance with the light emission intensity of an organic EL element. A key to this method is requirements for a photodetector. Specifically, it is required that a photodetector should have a sufficient sensitivity, exhibit good linearity with respect to input light, and have stable and uniform characteristics. While use of an off-biased amorphous silicon TFT or PIN diode has been proposed as a photodetector, there are problems that, for the former, the linearity of sensitivity and light current need to be improved and that, for the latter, an additional process need to be added to the manufacturing process. Further, due to the effects of non-linearity and parasitic capacitance of the proposed pixel circuit, it is difficult to realize completely uniform brightness characteristics. For example, Shin et al "A New Stable a-Si:H TFT Pixel for AMOLED by Employing the a-Si:H TFT Photo Sensor", SID 08 Digest, pgs. 1211-1214 discloses that a reduction in brightness caused by degradation of the light emission efficiency when optical compensation is performed can be reduced to ⅓ compared to when no optical compensation is performed.

SUMMARY OF THE INVENTION

In accordance with an aspect of the invention, there is provided a display apparatus including a plurality of pixels arranged in a matrix, in which each pixel is driven by a driving circuit, wherein each pixel includes a light emitting element which is a driven-by-current type; and a driving element which controls an electric current to be supplied to the light emitting element in accordance with a data signal representing a target brightness, and the driving circuit includes a detection unit which detects a mutual conductance of the driving element or a parameter which reflects the mutual conductance and a correction unit which corrects the data signal to be supplied to the driving element in accordance with a detection result obtained by the detection unit, the correction unit correcting the data signal such that a driving current to be supplied to the light emitting element in accordance with the data signal increases as the mutual conductance of the driving element decreases.

Further, it is preferable that the driving element is a thin film transistor, and the parameter which reflects the mutual conductance is a threshold voltage of the driving thin film transistor, or an input voltage necessary for causing a fixed electric current to flow in the driving thin film transistor, or a capacitor voltage for charging or discharging of a fixed capacitance in a fixed time period by the driving thin film transistor.

Further, it is preferable that the correction unit generates a correction data signal voltage having a positive correlation to the data signal and a variation amount of the detection result and also adds a voltage which cancels the variation amount of the detection result to the correction data signal voltage.

Further, it is preferable to provide a correction thin film transistor in which a data signal voltage or a fixed voltage is applied to a gate or a drain, a threshold voltage of the driving thin film transistor, or an input voltage necessary for causing a fixed electric current to flow in the driving thin film transistor, or a capacitor voltage for charging or discharging of a fixed capacitance in a fixed time period by the driving thin film transistor is applied to a drain or a gate, and a data signal is applied to a source, and a storage capacitor is charged with a correction data signal having a positive correlation to the data signal and a variation amount of the detection result.

In accordance with another aspect of the invention, there is provided a display apparatus including a plurality of pixels arranged in a matrix, in which a drain current of a first thin film transistor T1 provided in each pixel is supplied to a light emitting element to cause the light emitting element to emit light, the display apparatus including a first capacitor C1 having one terminal connected to a gate of the first thin film transistor T1; a fifth thin film transistor T5 having a drain connected to the other terminal of the first capacitor C1; a sixth thin film transistor T6 which connects a gate of the fifth thin film transistor T5 to the gate of the first thin film transistor; and a third thin film transistor T3 which connects the drain and the source of the first thin film transistor T1, wherein in a state in which a threshold voltage $V_{th}$ of the first thin film transistor T1 is held in the first capacitor C1, the first capacitor C1 is charged with a data signal voltage via the fifth thin film transistor to thereby write a voltage obtained by overcompensating for the threshold voltage $V_{th}$ in the first capacitor and drive the first thin film transistor based on the overcompensated voltage which is written.

Further, it is preferable that the above display apparatus further includes a second capacitor C2 which is connected to a source of the fifth thin film transistor T5 and holds a voltage at this connection point.

According to the present invention, it is possible to provide a display apparatus in which non-uniform brightness caused by degradation of both a driving TFT and a light emitting element is reduced to achieve excellent uniformity.

BRIEF DESCRIPTION OF THE DRAWINGS

A preferred embodiment of the present invention will be described in detail based on the following figures, wherein.

DETAILED DESCRIPTION OF THE INVENTION

Figure 2:
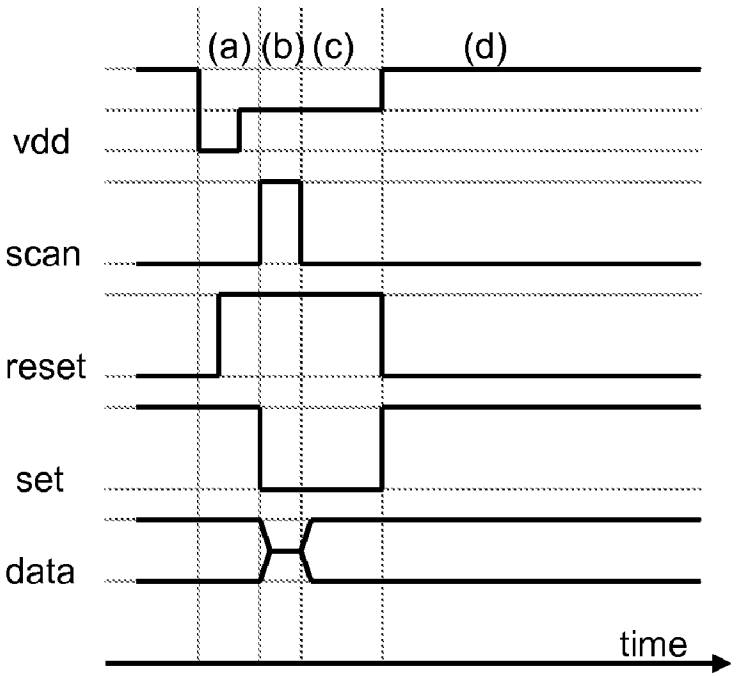
FIG. 2 is a timing chart illustrating the operation timing of each signal.

A preferred embodiment of the present invention will be described in detail with reference to the accompanying drawings.

"Principle Explanation"

The principle of the content of the present invention will first be described.

In general, a shift $\Delta V_{th}$ of a threshold voltage of an amorphous TFT when a constant current stress is applied (a constant current is continuously applied) is expressed as follows:

$$\Delta V_{th}=(V_g-V_{thi})^{\alpha}*(t/\tau_1)^{\beta} \quad (1)$$

Here, $V_g$ represents a gate voltage, $V_{thi}$ is a threshold voltage before application of stress, t is a time period of stress application, $\tau_1$ is a $V_{th}$ shift relieving time, and $\alpha$ and $\beta$ are exponents depending on bias and stress application time, respectively.

Similarly, degradation of light emission efficiency when an organic EL element is driven by a constant current can be expressed as follows:

$$\eta/\eta_i=1/(1+(t/\tau_2)^{\gamma}) \quad (2)$$

Here, $\eta$ and $\eta_i$ are current light emission efficiency of an organic EL element at a certain current density and an initial value thereof, t is a power generation time, $\tau_2$ is a time constant of degradation, and $\gamma$ is an exponent of degradation depending on time.

With the conventional $V_{th}$ compensation driving, $V_{th}$ at that time is detected and the detected $V_{th}$ is added to a data signal voltage for compensation, thereby driving a driving transistor (TFT).

With the $V_{th}$ overcompensation driving according to the present invention, on the other hand, in addition to compensation for $V_{th}$, an amount of compensation is modified in accordance with a variation amount $\Delta V_{th}$ of $V_{th}$. More specifically, the $V_{th}$ overcompensation driving aims at inducing the following voltage as a gate-source voltage $V_{gs}$ of the driving TFT.

$$V_{gs}=V_{data}*(1+\xi*\Delta V_{th})+V_{th} \quad (3)$$

Here, $V_{data}$ represents a data signal voltage, $V_{th}$ and $\Delta V_{th}$ are a threshold voltage of the driving TFT and a variation amount thereof, and $\xi$ is a constant determined by design. When the correction term $\xi*\Delta V_{th}$ of the above equation (3) is sufficiently small, the drain current $I_d$ of the driving TFT is expressed as follows:

$$I_d=(k/2)*V_{data}^2*(1+2*\xi*\Delta V_{th}) \quad (4)$$

Here, k is a mutual conductance coefficient of the driving TFT.

Light emission from an organic EL element, which can be obtained by multiplication of the drain current supplied from the driving TFT with a current light emission efficiency of the organic EL element, is expressed as follows according to the above formulas (1) to (4):

$$L/L_i=(1+2*\xi*(Vg-V_{thi})^{\alpha}*(t/\tau_1)^{\beta})/((1+(t/\tau_2)^{\gamma}) \quad (5)$$

Because the threshold voltage shift of an amorphous silicon TFT and degradation of light emission efficiency of an organic EL element do not result from a common physical process, $\beta$ and $\gamma$ in formulas (1) and (2) do not always correspond to each other. However, both $\beta$ and $\gamma$ often fall within the range between about 0.4 and 0.7 according to the element characteristics in examples which were actually measured. It is therefore sufficiently possible to select a combination of an organic EL element and a TFT element in which values of $\beta$ and $\gamma$ are close to each other.

Accordingly, due to a combination of elements (material, process, structure, and so on) and optimization of design parameters, it is considered that the following relationship can be satisfied:

$$\beta=\gamma \quad (6)$$

$$2*\xi*(Vg-V_{thi})^{\alpha}*(t/\tau_1)^{\beta}/(1+(t/\tau_2)^{\gamma}=1 \quad (7)$$

If the above formulas (6) and (7) can be satisfied, it is possible to maintain the light emission brightness of a pixel at a fixed level by compensating for a reduction of the current light emission efficiency of a degraded organic EL element by an increase of the drain current of the driving transistor which is overcompensated.

Actually, if the formulas (6) and (7) are satisfied to a certain degree, significant improvement of an image persistence life of a display apparatus can be expected.

Figure 1:
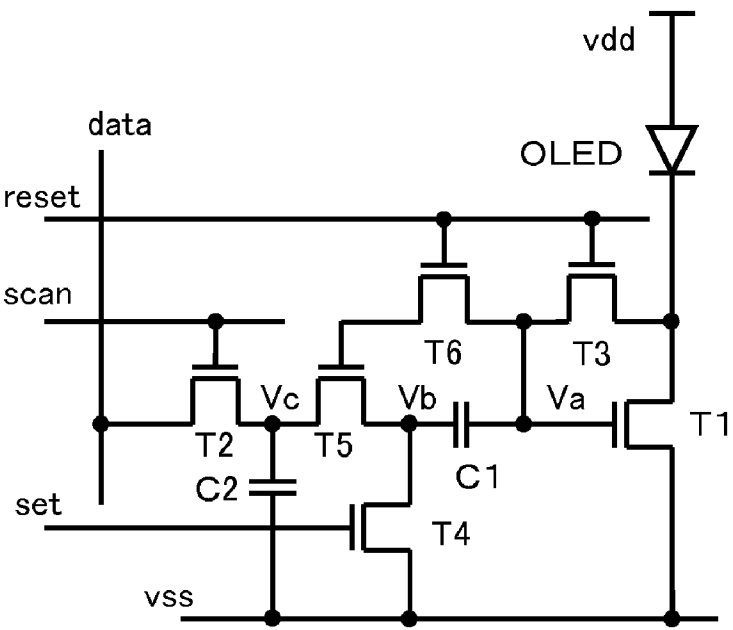
FIG. 1 is a diagram illustrating a structure of a pixel circuit.

FIG. 1 illustrates a single pixel circuit of a display apparatus according to an embodiment of the present invention and FIG. 2 illustrates driving waveforms thereof.

An anode of an organic EL element OLED is connected with a positive power source vdd and a cathode of the organic EL element OLED is connected to a drain of a driving transistor T1. A source of the driving transistor T1 is connected with a negative power source vss.

One terminal of a first capacitor C1 is connected to a gate of the driving transistor T1 and the other terminal of the first capacitor C1 is connected to one terminal (drain or source) of a transistor T5. The other terminal (source or drain) of the transistor T5 is connected to one terminal (drain or source) of a selection transistor T2, the other terminal (source or drain) of which is connected to a data line (data). Further, a gate of the selection transistor T2 is connected to a selection line (scan).

Further, one terminal (source or drain) of a transistor T6 is connected to a gate of the transistor T5, and the other terminal (drain or source) of the transistor T6 (drain or source) is connected to one terminal (source or drain) of a transistor T3, the other terminal (drain or source) thereof being connected to the drain of the driving transistor T1 (the cathode of the organic EL element). Further, a connection node between the transistor T6 and the transistor T3 is connected to the gate of the driving transistor T1 (the one terminal of the first capacitor), and the gates of the transistors T6 and T3 are connected to a reset line (reset).

In addition, a connection node between the transistor T2 and the transistor T5 is connected via a second capacitor C2 to the negative power source vss, and a connection node between the transistor T5 and the first capacitor is connected via a transistor T4 to the negative power source vss. A gate of the transistor T4 is connected to a set line (set).

Here, it is assumed that the gate of the driving transistor T1 is a node a, the connection node between the first capacitor C1 and the transistor T5 is a node b, and the connection node between the transistors T5 and T2 is a node c, and voltages at these nodes are Va, Vb, and Vc, respectively.

While in the pixel circuit illustrated in FIG. 1, N-channel TFTs are adopted for all the transistors, P-channel TFTs can be similarly adopted. In this case, polarities of a signal are reversed. Further, the organic EL element OLED should be connected to the drain of the driving transistor T1.

The driving method of the above-described circuit is illustrated in FIG. 2. As shown, one cycle of a display operation includes four steps: resetting a voltage of T1 (step (a)); detecting $V_{th}$ of T1 and superposing $V_{th}$ on $V_{data}$ (step (b)); merging $V_{data}$ and $V_{data}$ modulated voltage (step (c)); and emitting light (step (d)).

First, in step (a), in a state where the set line (set) is High, the reset line (reset) is set to High after the positive power source vdd is set to Low. As a result, the gate and drain of the driving transistor T1 are short-circuited by the transistor T5, and the drain of the transistor T1 is set to Low, so that the gate voltage and the drain voltage of the driving transistor T1 are reset. Then, the positive power source vdd is set to an intermediate level Mid. This causes the gate voltage Va of the driving transistor T1 to be a voltage which is higher than the source by $V_{th}$, and the first capacitor C1 is charged with $V_{th}$.

Next, in step (b), with the set line (set) being set to Low and the selection line (scan) being set to High, the transistor T4 is turned OFF and the selection transistor T2 is turned ON. Consequently, a data signal voltage $-V_{data}$ on the data line is set to the node c ($Vc=-V_{data}$). Here, because the transistor T6 is turned ON, the threshold voltage $V_{th}$ of the driving transistor T1 which is accumulated at the node a is applied to the gate of the transistor T5. Accordingly, through the transistor T5 whose gate voltage is set to $V_{th}$, the first capacitor C1 is charged with $-V_{data}$.

At this time, as an electric current of the transistor T5 is substantially in proportion to $V_{th}$, the voltage accumulated at node b is in proportion to a product of $-V_{data}$ and $V_{th}$. More specifically, the voltage Vb at the node b is not simply set to the data signal voltage $V_{data}$, but is a voltage which is in proportion to a product of $V_{data}$ and $V_{th}$ of the driving transistor at that time point. Because the gate voltage of the driving transistor T1 remains unchanged, the first capacitor C1 is charged with a difference voltage between the voltage Vb at the node b and the voltage Va at the node a.

Further, in step (c), the selection line (scan) is set to Low and the selection transistor T2 is turned OFF. The second capacitor C2 is charged with a difference between the intermediate voltage Mid of the positive power source vdd and the data signal voltage $-V_{data}$. When the selection transistor T2 is turned OFF, the voltages at the node b and the node c are merged. Consequently, a voltage corresponding to the first term ($V_{data}*(1+\xi*\Delta V_{th})$) in the above formula 3 is induced in the node b.

At this stage, as the potential at the node b is $-V_{data}*(1+\xi*\Delta V_{th})$ and the potential at the node a is $V_{th}$, the voltage accumulated at the first capacitor C1 is $V_{data}*(1+\xi*\Delta V_{th})+V_{th}$.

In step (d), by setting the reset line (reset) to Low, setting the set line (set) to High, the positive power source to High, and connecting the node b with the negative power source line vss, the potential at the node b becomes the same as the potential at the source of the driving transistor T1, the voltage $V_{data}*(1+\xi*\Delta V_{th})+V_{th}$ in formula (3) is applied between the gate and the source of the driving transistor T1, and the organic EL element OLED is driven with an electric current expressed in formula (4).

In this embodiment, the drain current of the driving transistor T1 is expressed as follows:

$$I_d=k_1/2*V'_{data}{}^2*(1+2*\xi*\Delta V_{th}) \quad (8)$$

which is in the same form as that of the above formula (4).

However, the following should be satisfied:

$$V'_{data}=c2/(c1+c2)*V_{data}*\sqrt{(1+k_5*\Delta t/c2)} \quad (9)$$

$$\xi=k_5*\Delta t/c2*(Vg-V_{thi})^{\alpha} \quad (10)$$

Here, $k_1$ and $k_5$ are mutual conductance of the transistors T1 and T5, respectively, and $\Delta t$ is a line selection time of the selection line (scan).

While the voltage of the positive power source vdd is changed in the above example, the voltage of the negative power source vss can be changed.

Figure 3:
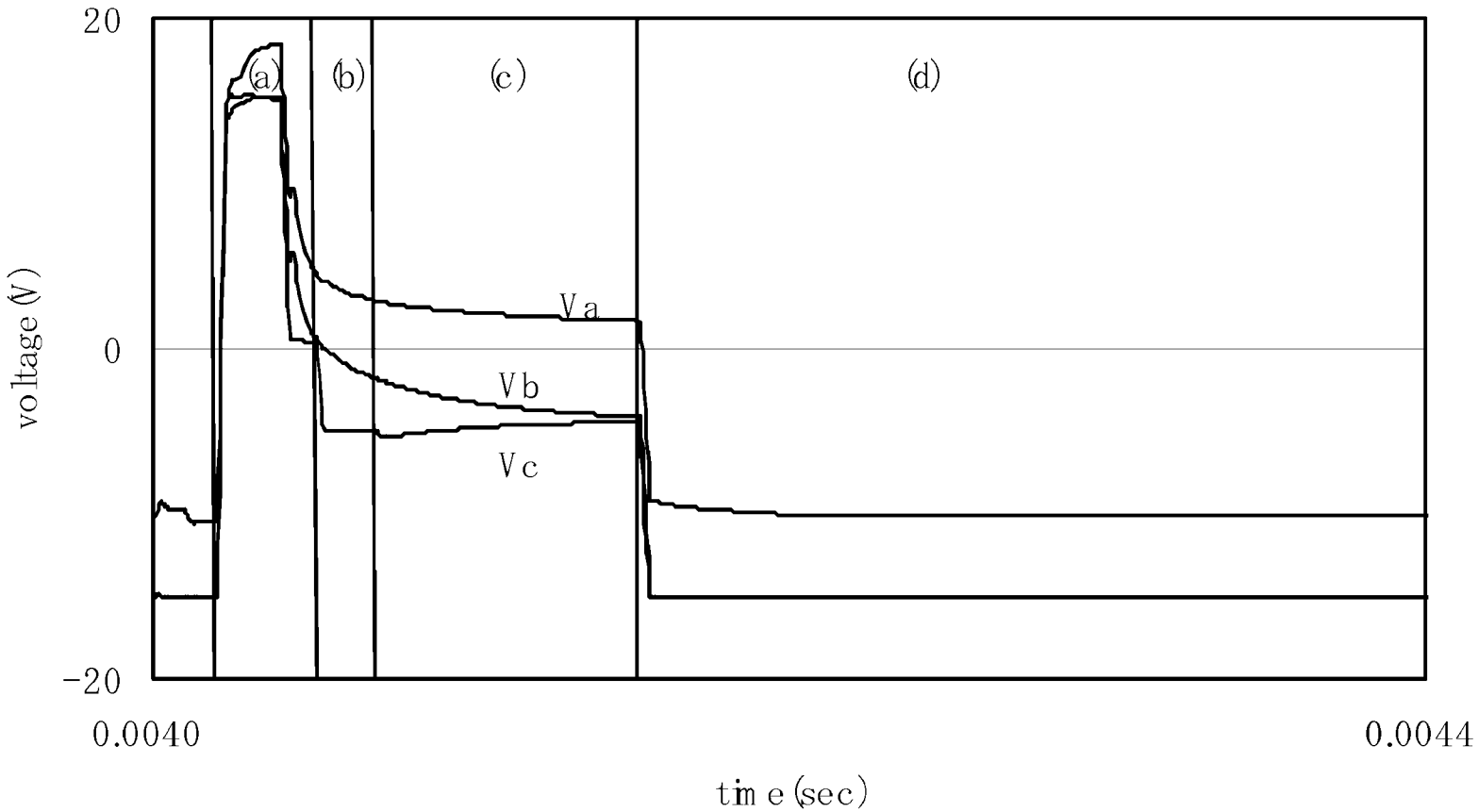
FIG. 3 is a chart illustrating a voltage waveform of each section by circuit simulation.

FIG. 3 illustrates voltage waveforms of circuit simulation according to the present embodiment. The circuit parameters at this time were as follows: a ratio of the gate width (W) and the gate length (L) (W/L) of the driving transistor T1 was 200/5, W/L of the transistors T2, T3, T4, and T6 was 20/5, W/L of the transistor T5 was 5/30, and a capacitance value of the first and second capacitors was 0.4 pF.

Figure 4:
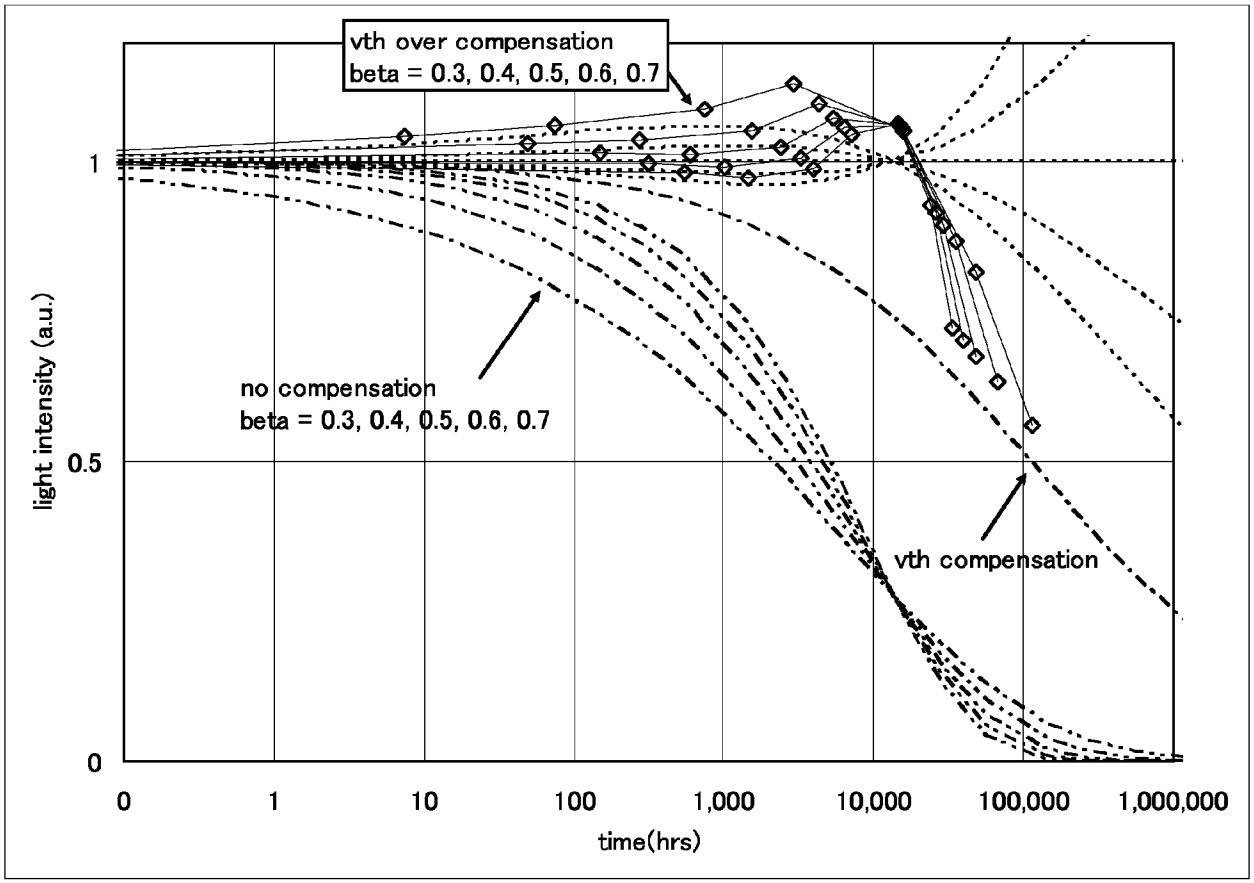
FIG. 4 is a diagram illustrating a simulation result of a pixel brightness change.

FIG. 4 illustrates simulation for deterioration of pixel brightness using the simulation results shown in FIG. 3 and the $V_{th}$ shift of the driving transistor T1 and the current light emission efficiency of a light emitting element, which are modeled with the above formulas (1) and (2).

In this simulation, electric current stress is applied to an organic EL element having a brightness half-life $\tau_2$ of 100,000 hours or longer, and a change of pixel brightness with elapse of time is measured for each of a case where no compensation is performed with respect to the pixel circuit (no compensation); a case where only $V_{th}$ compensation is performed (vth compensation); and a case where $V_{th}$ overcompensation is performed (vth over compensation). In this example, calculations are performed with $\gamma$ in the formulas (1) and (2) being fixed and $\beta$ being varied from 0.3 to 0.7. It can be understood that, compared to the case of only vth compensation, a time period until the brightness change exceeds about 5% of the initial value, which is so-called image persistence life, can be significantly improved. It can also be understood that sufficient effects can be expected if $\beta$ and $\gamma$ have close values, even if they do not have exactly the same value.

Figure 5:
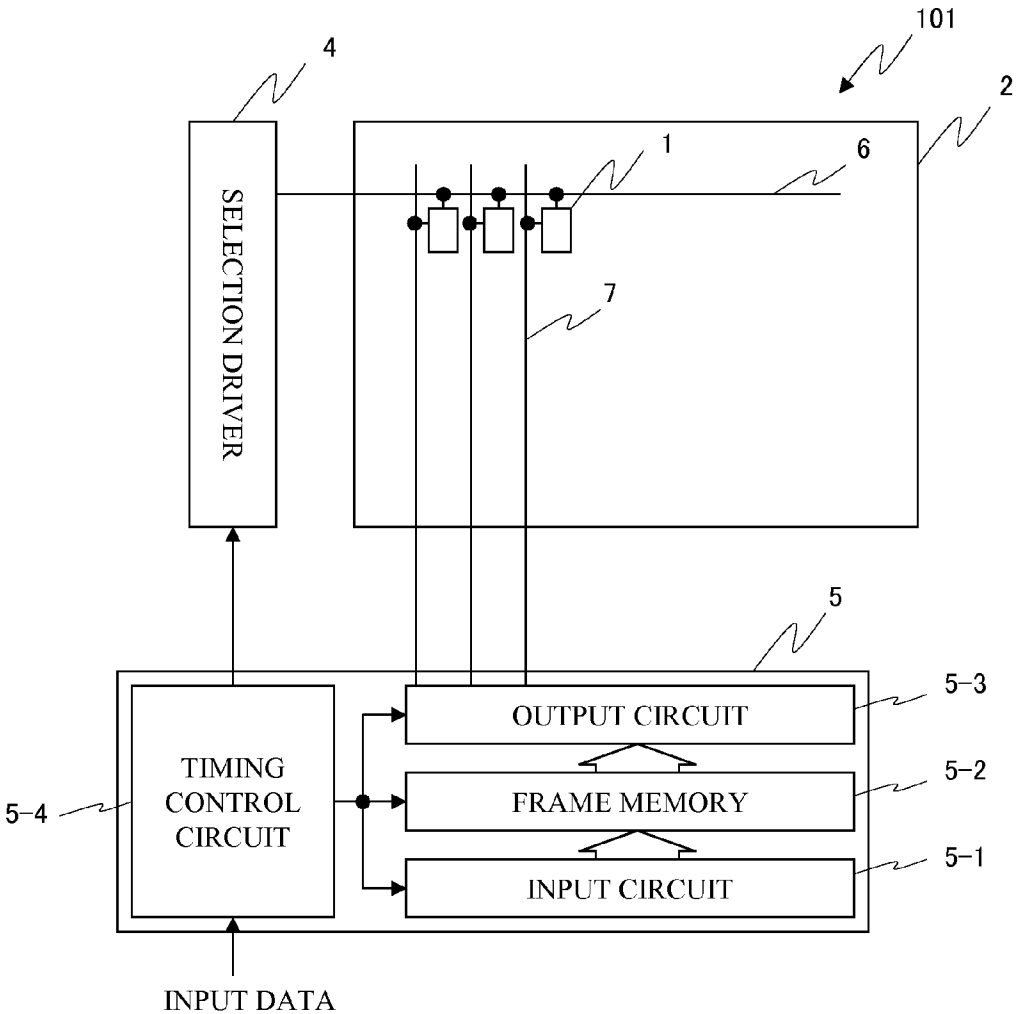
FIG. 5 is a diagram schematically illustrating a structure of a display apparatus.

FIG. 5 illustrates an overall structure of a display apparatus 101 according to the present embodiment. The display apparatus 101 includes a pixel array 2 having pixels 1 arranged in a matrix, a selection driver 4 which selects and drives a scan line 6, a data driver 5 which drives a data line 7, and the data line 7 which supplies a data signal voltage which is output from the data driver to the pixel 1. Here, in this drawing, a reset line (reset), a set line (set), and a negative power source (vss) are omitted. Further, while the pixel 1 normally emits light of one of red (R), green (G), and blue (B) colors, a pixel 1 which emits light of white (W) color can be further added to provide a full-color unit pixel. Also, while in this example, a stripe type array in which pixels 1 of one of RGBW colors are arranged in each column is adopted, a delta type array (a pixel array in a triangle form) or a quad type array (a pixel array in quadrants) can also be adopted.

The data driver 5 illustrated in FIG. 5 includes an input circuit 5-1, a frame memory 5-2, an output circuit 5-3, and a timing control circuit 5-4, and operates as a memory built-in type data driver. Data in dot units are externally input to the timing control circuit 5-4, which then generates a control signal in accordance with the input data and supplies the control signal to the input circuit 5-1, the frame memory 5-2, and the output circuit 5-3.

Data in dot units which are output from the timing control circuit 5-4 are converted into data in line units by the input circuit 5-1, and stored in line units in the frame memory 5-2. The data stored in the frame memory 5-2 are then read out in line units and transferred to the output circuit 5-3, and further output to the data line 7.

The selection driver 4 selects the scan line 6 in a line to which data are to be output, at a timing when data are output to the data line 7. Consequently, data from the data driver 5 are appropriately written in the pixel 1 of the corresponding line. Once the data are written, the selection driver 4 releases selection of the corresponding line, and repeats the operation for selecting the next line to be selected and releasing the selection. Further, the selection driver 4 also controls the voltage concerning other lines.

The selection driver 4, which can be formed of a low temperature poly-silicon TFT on the same substrate where the pixel 1 is provided, can be provides as a driver IC or can be integrated within the data driver 5.

Further, while in the above example, a voltage corresponding to the threshold value of the driving transistor T1 is supplied to the first capacitor C1 by the transistor T5 to overcompensate for the threshold voltage of the driving transistor T1, thereby compensating for deterioration of the organic EL element OLED, other methods can be used.

For example, a data signal is supplied from the data line (Data) to each pixel as a current signal, and the threshold voltage of the driving transistor is detected via the data line (Data) in the form of voltage. Then, in accordance with the threshold voltage which is detected, the data signal is corrected and supplied to each pixel, thereby compensating for the data.

In particular, it is preferable that a data signal prior to correction is output during the pre-charge period and a data signal which is corrected is output during the data charge period following the pre-charge period.

Also, it is preferable to add a correction term which is obtained by assigning an appropriate weight to a variation amount of the detection result, to the data signal by positive feedback.

While the preferred embodiment of the present invention has been described using specific terms, such description is for illustrative purposes only, and it is to be understood that changes and variations can be made without departing from the spirit or scope of the appended claims.

PARTS LIST

1 pixels
2 pixel array
4 selection driver
5 data driver
5-1 input circuit
5-2 frame memory
5-3 output circuit
5-4 timing control circuit
6 scan line
7 data line
101 display apparatus
C1 first capacitor
C2 second capacitor
T1—first thin film transistor
T2 selection transistor
T3 transistor
T4 transistor
T5 fifth thin film transistor
T6 transistor

The invention claimed is:

1. An electroluminescent (EL) pixel for correcting light emission efficiency of an EL element, comprising:

(a) a driving transistor for supplying electric current, the driving transistor having a mutual conductance and a threshold voltage;

(b) the EL element for emitting light in response to the electric current, the EL element having an efficiency;

(c) a detection unit for detecting a parameter which reflects the mutual conductance of the driving transistor; and (d) a correction unit for receiving a data signal representing a target brightness, generating a correction data signal using the data signal and the detected parameter, and supplying the correction data signal to the driving transistor, so that the driving transistor supplies electric current in accordance with the correction data signal, wherein the correction data signal overcompensates for variation in the threshold voltage of the driving transistor so that the correction data signal compensates for degradation of the efficiency of the EL element, wherein the parameter is the threshold voltage of the driving transistor, or a gate voltage necessary for causing a selected electric current to flow in the driving element, or a voltage for charging or discharging of a fixed capacitance in a fixed time period by the driving element, and wherein the correction unit includes a storage capacitor and a correction thin film transistor having a gate, a source and a drain, the detected parameter is applied to the drain or gate of the correction thin film transistor, and the data signal is applied to the source of the correction thin film transistor, so that the storage capacitor is charged with the correction data signal.

2. A display apparatus comprising:

(a) a pixel, including:

(i) a first thin film transistor (T1), having a threshold voltage, a source, a gate and a drain, for providing a drain current;

(ii) a light emitting element connected to the first thin film transistor (T1) which emits light in response to the drain current, wherein the light emitting element has an efficiency;

(iii) a first capacitor (C1) having first and second terminals, the first terminal being connected to the gate of the first thin film transistor (T1);

(iv) a second thin film transistor (T5) having gate and a source, and having a drain connected to the second terminal of the first capacitor (C1);

(v) a third thin film transistor (T6) having a channel that selectively connects the gate of the second thin film transistor (T5) to the gate of the first thin film transistor (T1); and (vi) a fourth thin film transistor (T3) having a channel that selectively connects the drain and gate of the first thin film transistor (T1);

(b) means for receiving a data signal voltage; and (c) means for holding the threshold voltage of the first thin film transistor (T1) in the first capacitor (C1) and charging the first capacitor (C1) with the data signal voltage, so that a correction voltage which overcompensates for the threshold voltage of the first thin film transistor (T1) is written in the first capacitor (C1) and the first thin film transistor (T1) is driven based on the correction voltage to compensate for degradation of the efficiency of the EL element.

3. The display apparatus of claim 2, wherein the pixel further comprises a second capacitor (C2) connected to the source of the second thin film transistor (T5).

4. The display apparatus of claim 3, further comprising a negative power source and a data line, wherein the pixel further comprises:

(vii) a fifth thin-film transistor (T4) having a channel that selectively connects the second terminal of the first capacitor (C1) to the negative power source [45P]; and (viii) a selection transistor (T2) having a channel that selectively connects the source of the second thin-film transistor (T5) to the data line.

* * * * *